US005904593A

United States Patent [19]

Saito et al.

[11] Patent Number: 5,904,593

[45] **Date of Patent: *May 18, 1999**

[54] CONNECTOR WITH TERMINAL RETAINING MECHANISM

[75] Inventors: Hitoshi Saito; Hisashi Tsukamoto, both of Shizuoka, Japan

[73] Assignee: Yazaki Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/628,162

[22] Filed: Apr. 5, 1996

[30] Foreign Application Priority Data

Apr. 11, 1995 [JP] Japan ..... 7-085650

[51] Int. Cl.[6] ..... H01R 13/40

[52] U.S. Cl. ..... 439/595

[58] Field of Search ..... 439/595, 752, 439/744

[56] References Cited

U.S. PATENT DOCUMENTS 4,975,082 12/1990 Nagasaka et al. ..... 439/595
5,071,369 12/1991 Denlinger et al. ..... 439/595
5,529,515 6/1996 Ohtaka et al. ..... 439/595
5,746,624 5/1998 Ohsumi et al. ..... 439/595

FOREIGN PATENT DOCUMENTS 61-7875 1/1986 Japan ..... H01R 13/422
1-174873 12/1989 Japan ..... H01R 13/42

*Primary Examiner*—Neil Abrams
*Assistant Examiner*—T C Patel
*Attorney, Agent, or Firm*—Morgan, Lewis & Bockius LLP

[57] ABSTRACT

After terminals have been inserted into terminal accommodating chambers, ends of retaining rods projecting from a spacer are moved toward entrances of refuge spaces for elastic retaining pieces that primarily retain the terminals. Then, the ends of the retaining rods are fitted into the refuge spaces. As a result, flexion of the elastic retaining pieces is regulated. On the other hand, when the terminals are inserted incompletely, the refuge spaces are substantially closed by the elastic retaining pieces.

5 Claims, 6 Drawing Sheets

CONNECTOR WITH TERMINAL RETAINING MECHANISM

BACKGROUND OF THE INVENTION

Field of the Invention

This invention relates to a connector having a terminal retaining mechanism, and in particular to a connector in which how terminals are being inserted can be detected with high accuracy.

Background

Connectors are used to form connections between wire harnesses, a wire harness and an electric device, and the like. A connector is so designed that electrical connection is established by a female terminal and a male terminal within a terminal accommodating chamber being connected to each other. In this case, terminals accommodated in the terminal accommodating chambers while being connected to the wire harness, are fitted respectively into the terminal accommodating chambers to prevent the terminals from rearward withdrawal due to a tensile force applied to the wire harness.

An exemplary structure for preventing terminals from rearward withdrawal is disclosed in, e.g., Japanese Utility Model Publication No. Hei. 6-7581. Such structure will be described with reference to FIGS. 8 to 10. In this structure for preventing terminals from rearward withdrawal, a spacer 14 is provisionally held while being inserted into a terminal accommodating chamber 12 formed in an insulating housing 10 from the front end of the insulating housing 10 in advance. Under this condition, a female terminal 16 is inserted into the terminal accommodating chamber 12 from the rear end of the insulating housing 10, as shown in FIG. 8, and when the female terminal 16 is inserted sufficiently deep into the terminal accommodating chamber 12, as shown in FIG. 9, the female terminal 16 is primarily retained by engagement with a, not shown, elastic retaining piece formed in the terminal accommodating chamber 12.

When the spacer 14 is moved upward, as shown by the arrow A in FIG. 9, after the female terminal 16 has been primarily retained, a retaining protuberance 20 formed on the terminal 16 is fitted into a retaining groove 18 of a retaining rod 22 projecting from the spacer 14, and the retaining protuberance 20 brings the rear end edge thereof into contact with an end 18*a* of the retaining groove 18. As a result, the female terminal 16 is secondarily retained in the terminal accommodating chamber 12 so as to be unreleasable rearward from the terminal accommodating chamber, thereby allowing itself to be firmly held by the insulating housing 10. Although the elastic retaining piece is not shown in the drawings to simplify the drawings, the movement of the elastic retaining piece is regulated by the spacer 14 coming into contact with it, thereby preventing the elastic retaining piece and the terminal 16 from being disengaged from each other due to an accident or the like.

On the other hand, in the case of incomplete insertion, in which the female terminal 16 is not accommodated in the terminal accommodating chamber 12 reliably as shown in FIG. 10, the spacer 14 cannot move upward with the retaining rod 22 because it has collided against the retaining protuberance 20. Therefore, the incomplete insertion of the female terminal 16 can be detected.

However, when a large force is upwardly applied to the spacer 14 even if the female terminal 16 has been inserted improperly as shown in FIG. 10, the spacer 14 pivots about a pivot point P which causes the upper surface of the retaining rod 22 to come into contact with the retaining protuberance 20, which in turn causes the spacer 14 to be regularly retained in a undesirable configuration whereby in insulating housing 10 the spacer 14 is disposed upwardly at an angle toward the front end of the insulating housing 10. This creates the problem that the operator cannot judge by the displacement of the spacer 14 whether or not the female terminal 16 has been properly inserted into the terminal accommodating chamber 12.

Furthermore, if the terminal 16 is improperly inserted into the insulating housing 10 another problem arises whereby the terminal 16 cannot be released from the terminal accommodating chamber 12 without the spacer 14 being removed from the housing 10 completely.

SUMMARY OF THE INVENTION

The present invention has been made to overcome these problems encountered by the conventional art. Therefore, the object of the invention is to provide a connector having a terminal retaining mechanism in which not only an improper insertion of the terminal can be reliably detected but also the prevention of a reduction in accuracy detection due to the downsizing of the connector is prevented and the operation of releasing the terminal upon improper insertion of the terminal can be easily performed.

To achieve the above objective, the invention is applied to a connector having a terminal retaining mechanism. In the connector having a terminal retaining mechanism of the invention, a refuge space allowing an elastic retaining piece to be fitted thereinto is arranged in a connector housing. The elastic retaining piece is engageable with a terminal within a terminal accommodating chamber and flexes as insertion of the terminal into the terminal accommodating chamber progresses. Furthermore, a spacer is inserted into a bottomed spacer guide hole that is arranged in a front surface of the connector housing, so that movement of the elastic retaining piece can be regulated.

Additionally, in the connector of the present invention, the refuge space communicates with a bottom portion of the spacer guide hole. The spacer has a retaining rod projecting so as to be fitted into the refuge space. After the terminal has been inserted into the terminal accommodating chamber either by bringing an end of the retaining rod into contact with the bottom portion or by positioning the end of the retaining rod in front of the bottom portion, the end of the retaining rod is moved and positioned at an entrance of the refuge space.

According to the invention, the connector housing has not only a refuge space into which an elastic retaining piece is pushed out by the terminal inserted into the receded terminal accommodating chamber is receded, but also a spacer guide hole that communicates with the refuge space. Also, the spacer has a retaining rod projecting therefrom, the retaining rod being formed so as to be fitted into the spacer guide hole and the refuge space. As a result of this construction, the spacer that has been provisionally held in the spacer guide hole causes the end of the retaining rod to move toward the entrance of the refuge space after the terminal inserted into the terminal accommodating chamber has been retained by the elastic retaining piece, so that the spacer can thereafter be pushed into a predetermined position within the refuge space. Conversely, if the terminal is inserted into the terminal accommodating chamber incompletely, the elastic retaining piece closes the space while positioned in the refuge space. Therefore, the retaining rod cannot move toward the entrance of the refuge space, which in turn allows the operator to detect the incomplete insertion of the terminal.

DETAILED DESCRIPTION OF THE PREFERRED EMBODIMENTS

A connector having a terminal retaining mechanism, which is an embodiment of the invention, will now be described with reference to the drawings.

Figure 1:
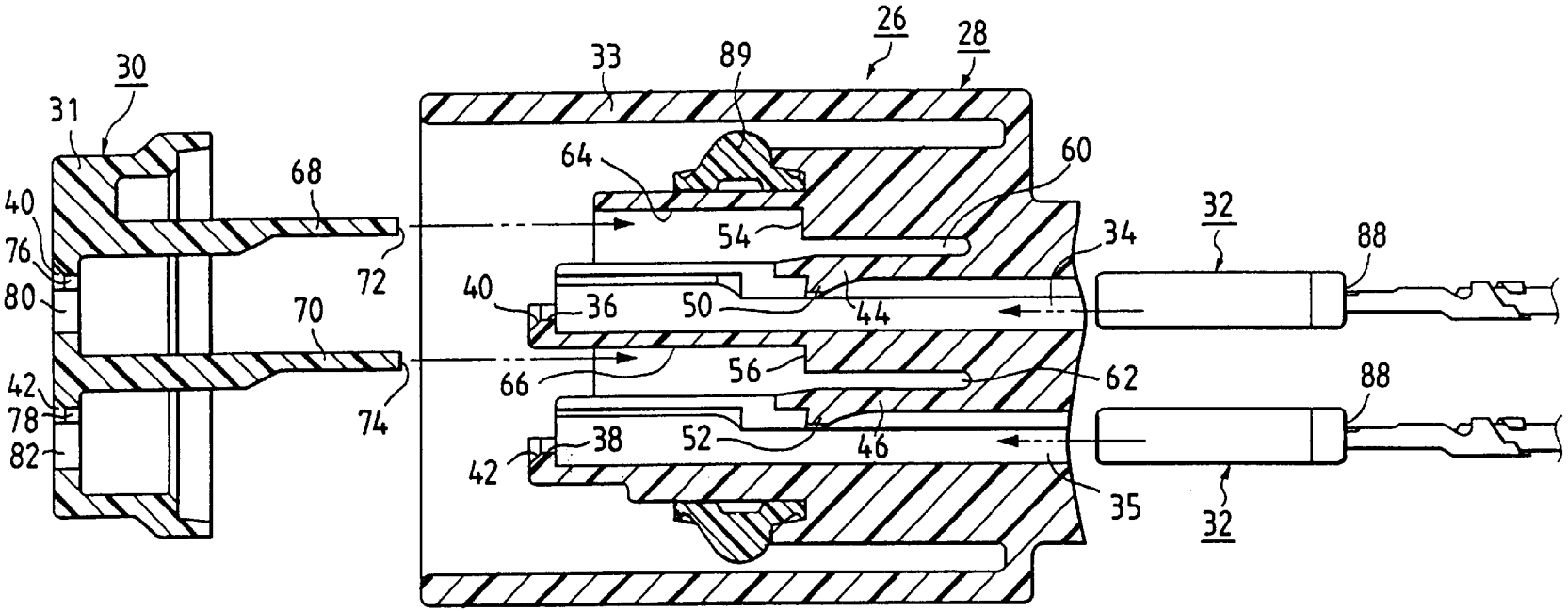
FIG. 1 is a sectional view of a connector with a terminal retaining mechanism, which is an embodiment of the invention.
Figure 2:
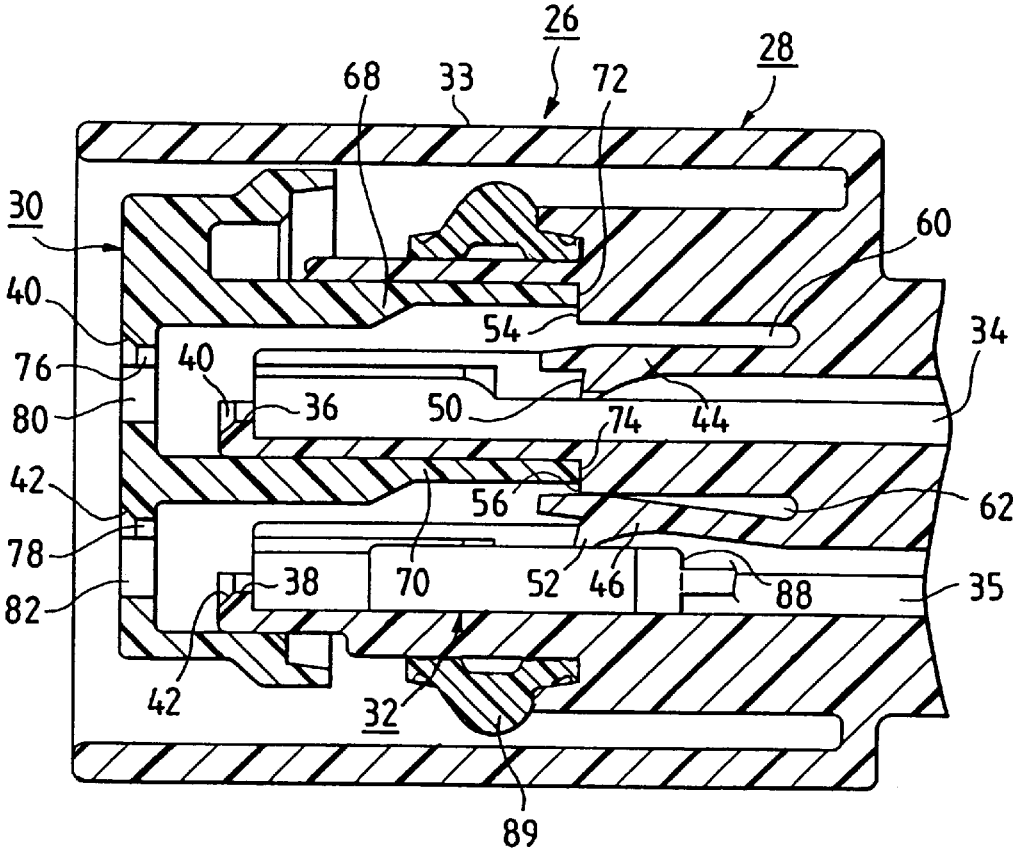
FIG. 2 is a sectional view of the connector shown in FIG. 1 with a terminal being inserted.
Figure 3:
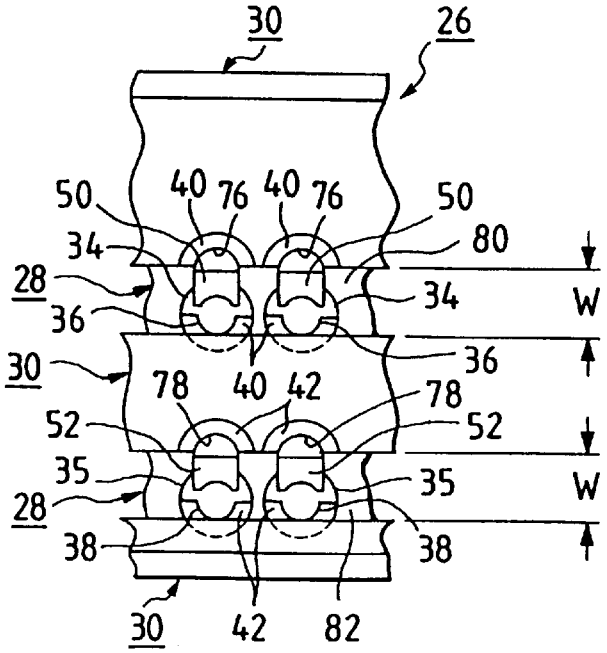
FIG. 3 is a partial front view of the connector shown in FIG. 2.
Figure 4:
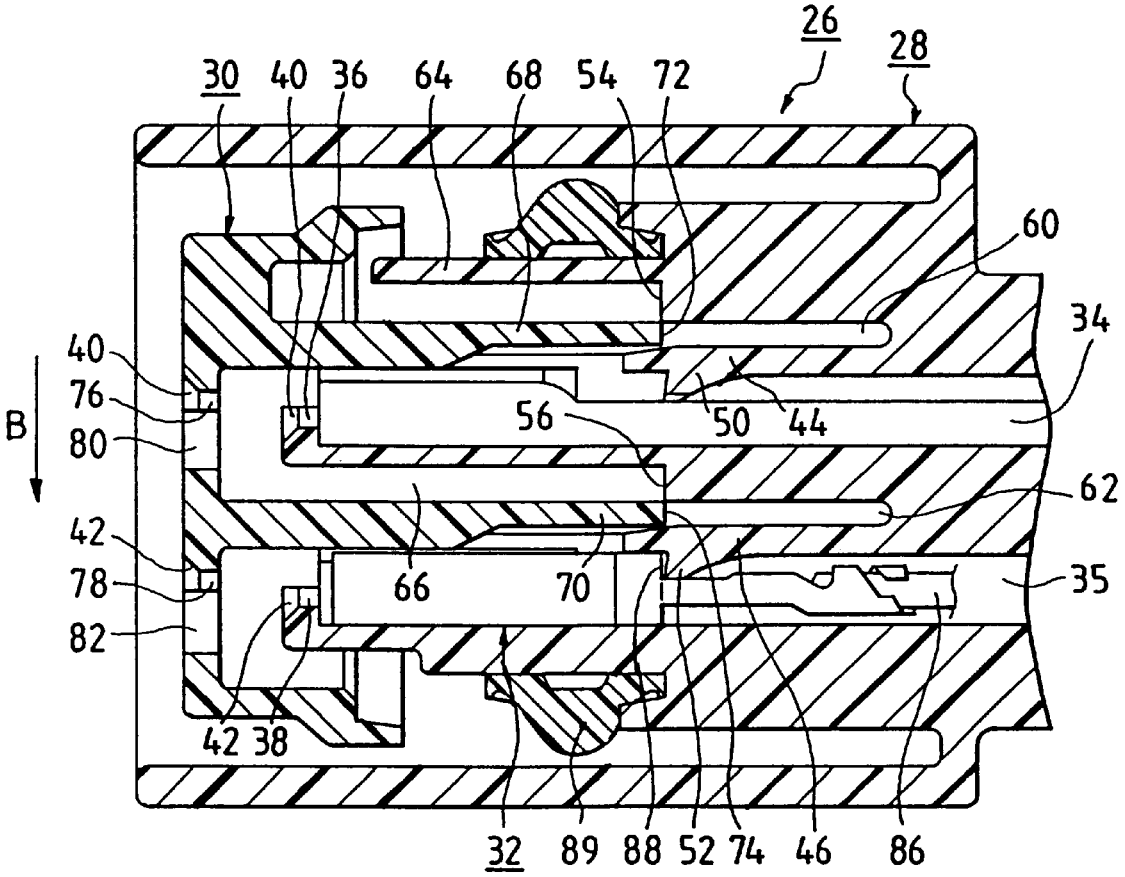
FIG. 4 is a sectional view of the connector shown in FIG. 1 with a terminal being assembled.
Figure 5:
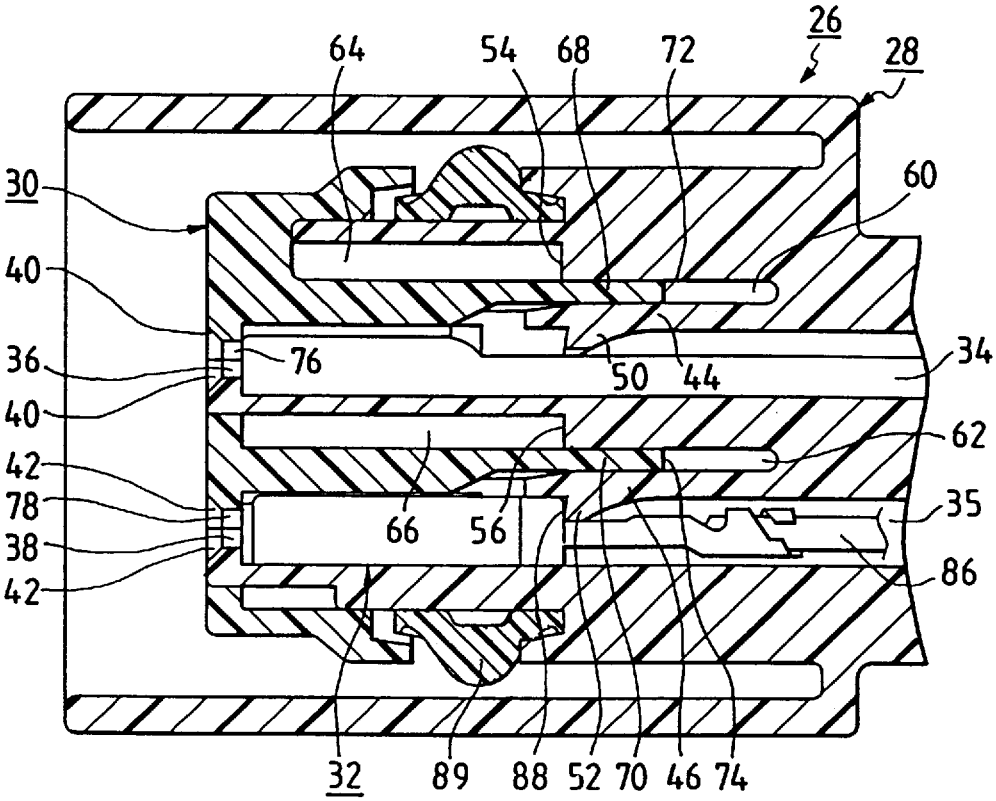
FIG. 5 is a sectional view of an assembled connector with a spacer regularly retained.
Figure 6:
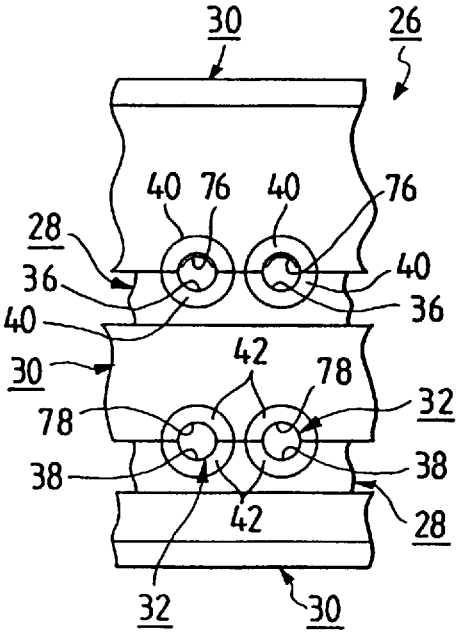
FIG. 6 is a partial front view of the connector shown in FIG. 5.
Figure 7:
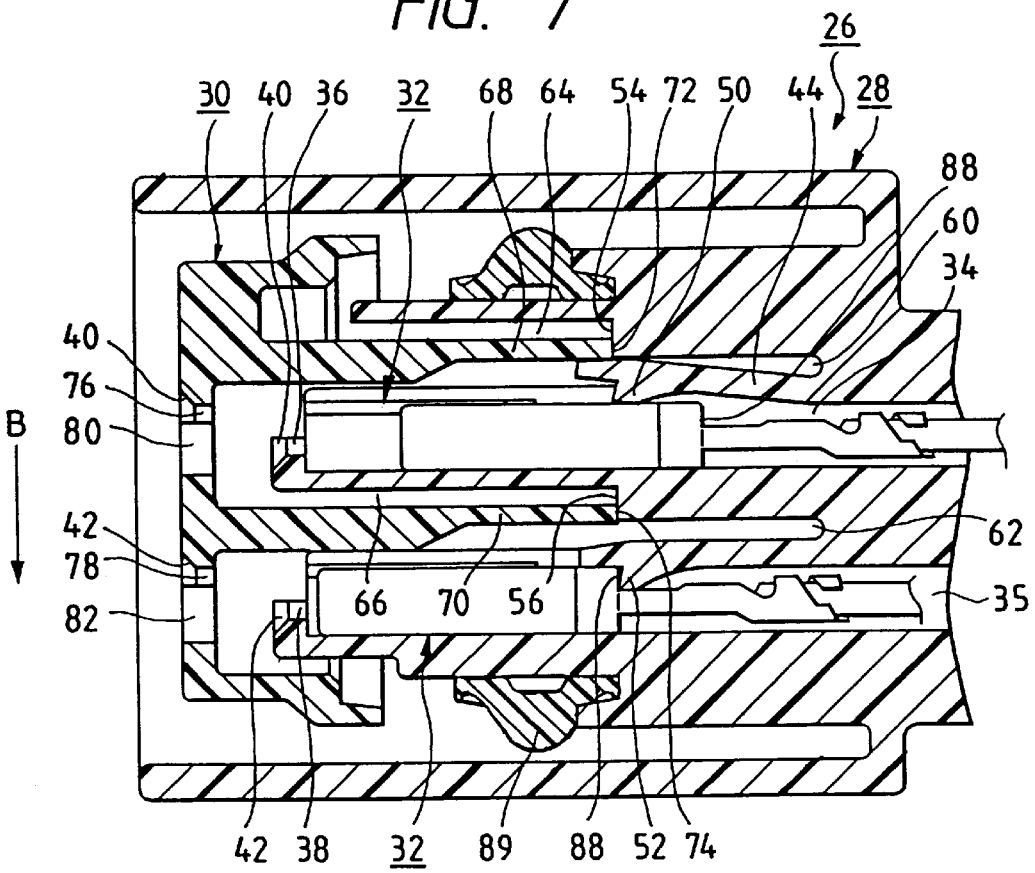
FIG. 7 is a sectional view of the connector shown in FIG. 1 with a terminal incompletely inserted.
Figure 8:
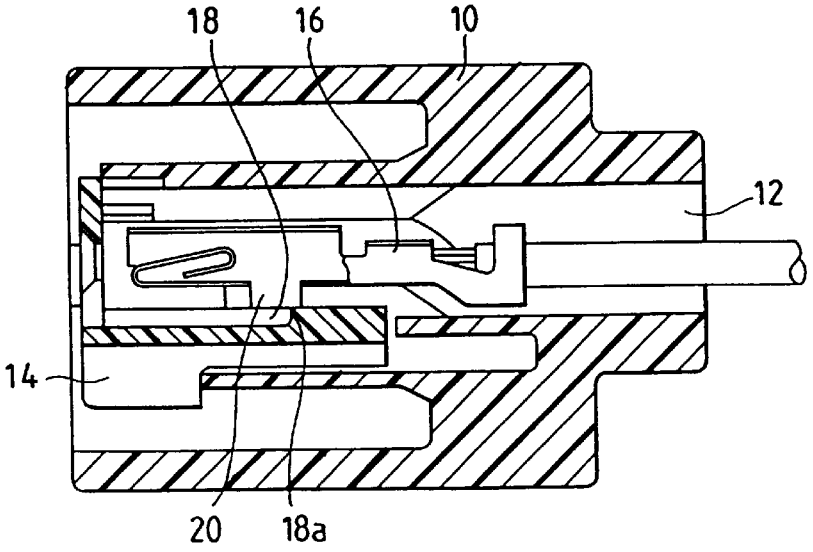
FIG. 8 PRIOR ART
FIG. 8 is a sectional view illustrative of an assembling condition of a connector according to a conventional art.
Figure 9:
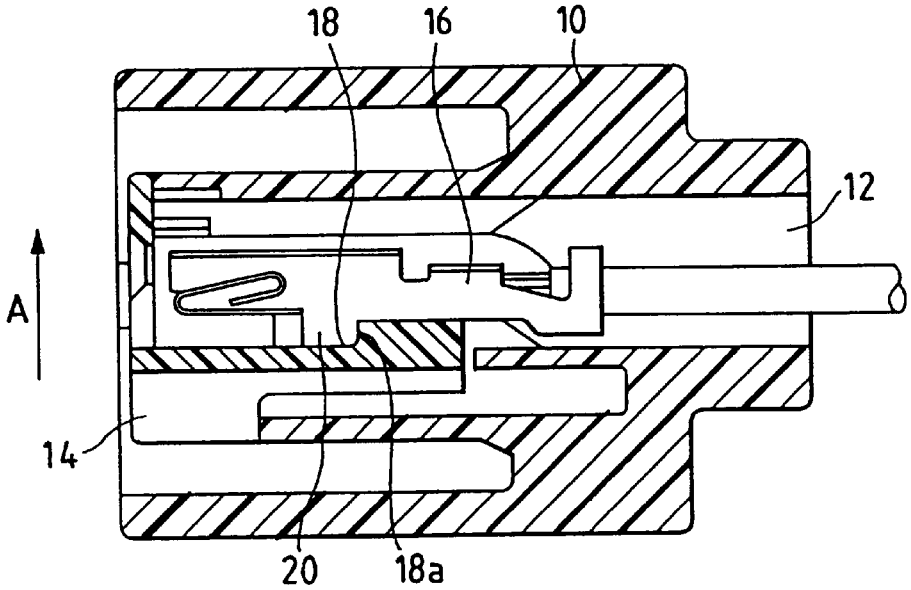
FIG. 9 PRIOR ART
FIG. 9 is a sectional view illustrative of an assembling condition of the connector according to the conventional art.
Figure 10:
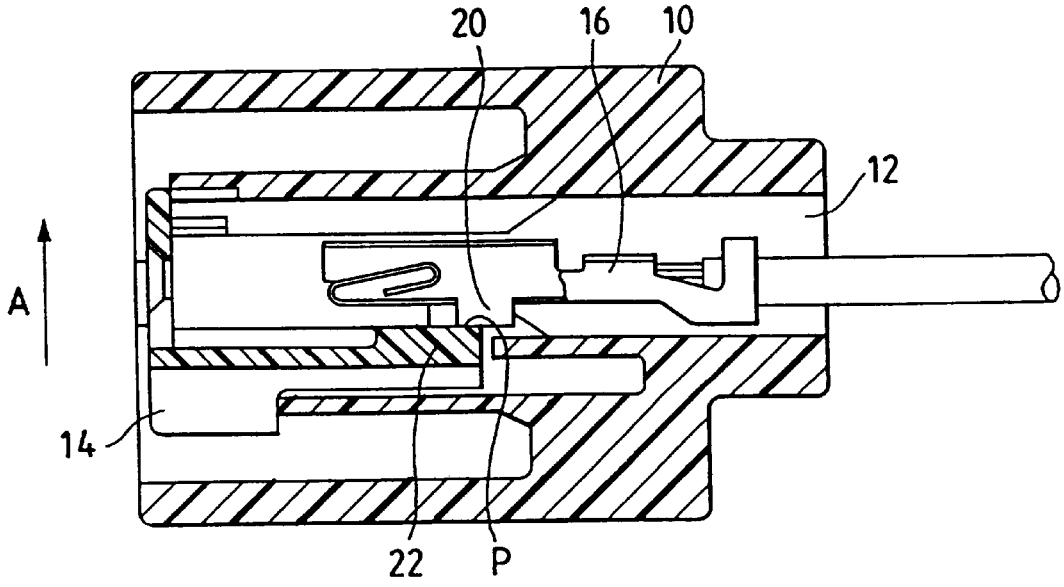
FIG. 10 PRIOR ART
FIG. 10 is a sectional view illustrative of an assembling condition of the connector according to the conventional art.

FIGS. 1 to 7 show the embodiment of the invention. FIG. 1 is a sectional view of an unassembled connector with a spacer separated from a connector housing; FIG. 2 is a sectional view of the connector with a terminal being inserted; FIG. 3 is a partial front view of the connector shown in FIG. 2; FIG. 4 is a sectional view of the connector that is in the course of being assembled with a terminal being primarily retained; FIG. 5 is a sectional view of the assembled connector with a spacer regularly retained; FIG. 6 is a partial front view of the connector shown in FIG. 5; and FIG. 7 is a sectional view of the connector with a terminal incompletely inserted.

As shown in FIG. 1, a connector 26 having a terminal retaining mechanism, which is an embodiment of the invention, includes a connector housing 28, a spacer 30, and terminals 32 (the female terminals are shown in this embodiment). The connector housing 28 is integrally formed of an insulating resin material, and has on an outer periphery thereof a hood 33 that is formed into a cylindrical body so that a mating connector (not shown) can be received therein.

The connector housing 28 has two stages of terminal accommodating chambers, an upper terminal accommodating chamber 34 and a lower terminal accommodating chamber 35. A plurality of chambers are horizontally juxtaposed in each stage (see FIG. 3). Semi-arcuate recesses 36, 38 are formed at ends of the terminal accommodating chambers 34, 35, respectively, the end being on the front side of the housing. The circumferential edges of the recesses 36, 38 have downwardly tapered surfaces 40, 42.

Elastic retaining pieces (hereinafter referred to as the "lances") 44, 46 are formed respectively in the terminal accommodating chambers 34, 35 so as to extend from the inner side walls of the terminal accommodating chambers 34, 35 and so as to be resiliently deformable. The respective lances 44, 46 not only are cantilevered with the bases thereof coupled to the side walls of the terminal accommodating chambers 34, 35, but also form refuge spaces 60, 62 with respect to the inner side walls of the housing 28 in the axial direction thereof. Further, retaining protuberances 50, 52 are formed respectively close to the free ends of the lances 44, 46 so as to face the terminal accommodating chambers 34, 35.

As a result of the aforementioned construction, when the terminal 32 is inserted into, e.g., the lower terminal accommodating chamber 35 from the rear end of the housing 28, the lance 46 recedes into the refuge space 62 with the retaining protuberance 52 coming in colliding contact with the terminal 32 (see FIG. 2).

The refuge spaces 60, 62 communicate with spacer guide holes 64, 66 that are formed by opening the front of the connector. More specifically, the spacer guide holes 64, 66 are such that bottom portions 54, 56 toward the rear of the connector are made partially continuous to the respective refuge spaces 60, 62.

The bottom portions 54, 56 of the spacer guide holes 64, 66 allow ends 72, 74 of a plurality of retaining rods 68, 70 to collide against themselves (or to position in front of themselves) when the spacer 30 to be described later is inserted from the front of the connector. Further, the refuge spaces 60, 62 are arranged so as to allow the retaining rods 68, 70 to be fitted thereinto.

The spacer 30 is inserted into the spacer guide holes 64, 66 to substantially close the spacer guide holes 64, 66. The spacer 30 has a caplike shape so as to be fitted with the outer peripheral surface of the connector. From main body 31 of the spacer 30 projects the retaining rods 68, 70, which are slidable along the spacer guide holes 64, 66 and which are fitted into the refuge spaces 60, 62. The retaining rods 68, 70 have the ends 72, 74 thereof formed so as to be more slender than the roots (base portions) thereof. In addition, through holes 80, 82 are formed at lower positions of the retaining rods 68, 70 in the main body 31 of the spacer 30.

As shown in FIG. 3, the through holes 80, 82 have semi-arcuate recesses 76, 78. The recesses 76, 78 are arranged so as to confront the recesses 36, 38 on the side of the connector. Furthermore, tapered surfaces 40, 42 corresponding to the tapered surfaces 40, 42 of the recesses 36, 38 formed on the housing 28 are arranged on the circumferential edges of the recesses 76, 78.

It may be noted that a rear end edge 88 is formed on each terminal 32. The rear end edge 88 is engageable with the retaining protuberance 50 or 52 of the lance 44 or 46 when the terminal 32 is accommodated in the terminal accommodating chamber 34 or 35. Additionally, a watertight packing 89 is fitted with the outer peripheral surface of the connector housing 28 between the connector housing 28 and the hood 33.

An operation of the connector having the terminal retaining mechanism will be described next.

First, the retaining rods 68, 70 of the spacer 30 are inserted so as to slide along the spacer guide holes 64, 66 from the front of the connector 26 as shown in FIG. 2. As a result, the ends 72, 74 of the retaining rods 68, 70 come in colliding contact with or are positioned in front of the bottom portions 54, 56. At this instance, the spacer 30 is in a stand-by condition while being provisionally held. The recesses 76, 78 of the spacer 30 are moved away from the recesses 36, 38 of the housing 28 a predetermined distance W (see FIG. 3) while in the stand-by condition.

When the terminal 32 is inserted into, e.g., the lower terminal accommodating chamber 35 from the rear end side of the housing, the lance 46 comes in contact with the terminal 32 and is flexed upward and recedes into the refuge space 62 (see FIG. 2). When the terminal 32 is further inserted into the terminal accommodating chamber 35 to reach a predetermined position under the aforementioned conditions, the lance 46 primary function is to retain the terminal 32 preventing the terminal 32 from rearward withdrawal once the lance 46 resiliently returns to to its original position and engages the rear end edge 88 of the terminal 32 (see FIG. 4). Upon, completion of the insertion operation the refuge space 62 is no longer restricted and the lance 46 is retained.

When, the spacer 30 is lowered, as shown by the arrow B in FIG. 4, to its normal position, the retaining rods 68, 70 are positioned at the entrances of the refuge spaces 60, 62 with the ends 72, 74 losing thereof contact with the bottom portions 54, 56. When the spacer 30 is pushed into the housing 28 toward the rear end of the connector as shown in FIG. 5, with the aforementioned conditions maintained, the retaining rods 68, 70 of the spacer 30 are fitted into the refuge spaces 60, 62 to the predetermined positions. As a result, the retaining rods 68, 70 overlap the lances 44, 46, respectively, at portions close to the free ends of the lances 44, 46 in the flexing direction. Hence, the flexion of the lances 44, 46 is regulated by the retaining rods 68, 70, thereby firmly holding the terminal 32 so as to prevent the terminal 32 from rearward withdrawal from the terminal accommodating chamber 35. It may be noted that the spacer 30 and the housing 28 form through holes that coincide with the through holes 80, 82 of the spacer 30 with the recesses 76, 36 and the recesses 78, 38 integrated with each other, respectively, as shown in FIGS. 5 and 6.

Moreover, the integrated tapered surfaces 40, 42 are formed around the circumferences of the through holes (the through holes 80, 82) that are formed of the recesses 76, 36 and the recesses 78, 38. Therefore, male terminals, of the not shown mating connector, can be smoothly fitted into these through holes. The male terminals that have passed through these through holes are electrically connected to the female terminals 32.

It should be noted that the connector 26 has stoppers (not shown) that position the spacer 30 at the provisional retaining position and at the regular retaining position.

Additionally, how the terminal 32 is inserted into the terminal accommodating chamber 35 and how the retaining rod 70 of the spacer 30 is fitted into the refuge space 62 has been described in the foregoing. However, it goes without saying that a similar operation is performed by the upper terminal accommodating chamber 34 and the components and members corresponding to the upper terminal accommodating chamber 34.

Still further, the spacer 30 allows the operator to detect reliable accommodation of the terminals 32 in the terminal accommodating chambers 34, 35 upon fitting the retaining rods 68, 70 into the refuge spaces 60, 62 of the housing 28, respectively.

On the other hand, when the female terminal 32 is inserted into, e.g., the upper terminal accommodating chamber 34 incompletely as shown in FIG. 7, the lance 44 is pushed upward within the refuge space 60 and closes the refuge space 60 with the retaining protuberance 50 coming in contact with the terminal 32. Therefore, when the spacer 30 is lowered in the direction indicated by the arrow B so as to be regularly retained, the retaining rod 68 comes to collide against the upper surface of the lance 44 before moving toward the entrance of the refuge space 60.

As a result, the respective retaining rods 68, 70 have the position thereof regulated with the ends 72, 74 thereof either colliding against or being in front of the bottom portions 54, 56 of the spacer guide holes 64, 66, and therefore are not allowed to be fitted into the refuge spaces 60, 62. Even if the spacer 30 is pushed toward the rear end of the connector incorrectly, the retaining rods 68, 70 are not allowed to be inserted into the refuge spaces 60, 62 since the ends 72, 74 collide against the bottom portions 54, 56. Hence, the spacer 30 allows the operator to detect incomplete insertion of the female terminal 32 into the upper terminal accommodating chamber 34.

Also, when the spacer 30 is pulled upward to return to the provisional held condition in the case where the terminals 32 have been improperly inserted into the terminal accommodating chambers 34, 35 and where the lance 44 has been primarily retained, clearances, each being equal to the predetermined distance W, are produced between the housing 28 and the spacer 30 as shown in FIG. 3. If the lances 44, 46 are flexed so as to be pushed upward toward the refuge spaces 60, 62 by inserting a tool from these clearances, the terminals 32 can be released from the terminal accommodating chambers 34, 35 from the back. That is, the terminals 32 can be released easily without taking the trouble of removing the spacer from the housing completely as described with reference to the conventional art. As a result, the number of operational steps can be reduced.

Finally, with regard to the downsizing of the connector, the spacer comes into colliding contact with the upper surface of the lance, not with the lance itself, whose mechanical strength is reduced as a result of the downsizing of the connector. Therefore, the lance is not subject to breakage or the like, which in turn allows the operator to detect the inserted condition of the terminal satisfactorily. In addition, the spacer comes in contact with the lance and therefore regulates the lance that is engaged with a completely inserted terminal, which in turn allows such terminal to be engaged doubly.

In the case where the female terminal is assembled in the housing as has been described in the aforementioned embodiment, the invention is not limited to such embodiment. Similar advantages can be provided by assembling a male terminal in the housing.

As described in the foregoing, according to the connector having a terminal retaining mechanism of the invention, the elastic retaining piece (lance) is primarily retained with respect to a terminal accommodated in the terminal accommodating chamber. The retaining rod of the spacer, provisionally held in the spacer guide hole is then moved toward the entrance of the refuge space for the lance, and it is thereafter that the retaining rod is inserted to a predetermined position within the refuge space. Therefore, the closing of the refuge space by the lance due to incomplete insertion of the terminal can be easily detected.

What is claimed is:

1. A connector, comprising:

a housing;

a terminal accommodating chamber formed in said housing to receive a terminal;

an elastic terminal retaining piece formed in said terminal accommodating chamber to retain said terminal received therein;

a refuge space positioned at a back side of said terminal retaining piece for receiving said terminal retaining piece, upon displacement of said terminal retaining piece by said terminal;

a spacer guide hole communicating with said refuge space, and opening to a front end of said housing;

a bottom portion formed in a stepped manner between said refuge space and said spacer guide hole; and a spacer including a main body, and a retaining rod having an end portion to be inserted into said refuge space, projected from said main body, wherein said connector is configured such that after said terminal is inserted into said terminal accommodating chamber, the end portion of said retaining rod is inserted into said refuge space either by bringing the end portion of said retaining rod into contact with said bottom portion or by positioning the end portion of said retaining rod in front of said bottom portion first, and then by sliding the end portion downward to fit the end portion into the refuge space; and wherein said connector is configured such that upon improper insertion of said terminal into said terminal accommodating chamber, said retaining rod cannot engage with said refuge space but contact only an upper surface of said elastic retaining piece without damaging said retaining piece, thus communicating improper insertion of said terminal to an operator.

2. The connector of claim 1, wherein the end portion of the retaining rod is more slender than a base of the retaining rod thereof.

3. The connector of claim 1, wherein said terminal accommodating chamber includes a first semi-arcuate recess formed on a front end of a lower side wall thereof, a through hole formed through said main body of said spacer has a second semi-arcuate recess corresponding to the first semi-arcuate recess, and wherein a terminal insertion hole for receiving a mating terminal is formed by the first semi-arcuate recess being united with the second semi-arcuate recess in accordance with the insertion of the end portion of said retaining rod into said refuge space.

4. The connector of claim 3, wherein said first semi-arcuate recess has a first tapered surface, said second semi-arcuate recess has a second tapered surface corresponding to the first tapered surface.

5. The connector of claim 1, wherein said retaining rod overlaps a portion of said terminal retaining piece close to a free end of said terminal retaining piece in a flexing direction at a terminal inserted position.

* * * * *